US006750780B1

(12) United States Patent
Bitelli

(10) Patent No.: US 6,750,780 B1
(45) Date of Patent: Jun. 15, 2004

(54) REMOTE CONTROLLING DEVICE FOR OPERATIVE MACHINES

(75) Inventor: Romolo Bitelli, S. Lazzaro (IT)

(73) Assignee: Bitelli SPA (IT)

( * ) Notice: Subject to any disclaimer, the term of this patent is extended or adjusted under 35 U.S.C. 154(b) by 0 days.

(21) Appl. No.: 09/267,689

(22) Filed: Mar. 15, 1999

(30) Foreign Application Priority Data

Mar. 27, 1998 (IT) ..... VI98A0062

(51) Int. Cl.[7] ..... G08C 19/00

(52) U.S. Cl. ..... 340/825.69; 340/10.34; 398/115

(58) Field of Search ..... 340/825.69, 10.34, 340/825.72; 359/146, 145; 398/115, 116, 117

(56) References Cited

U.S. PATENT DOCUMENTS

| | | | | |
|---|---|---|---|---|
| 3,641,575 A | | 2/1972 | Auer, Jr. et al. | |
| 4,827,395 A | * | 5/1989 | Anders et al. | 340/825.72 |
| 4,904,993 A | | 2/1990 | Sato | 340/825.72 |
| 4,916,532 A | * | 4/1990 | Streck et al. | 359/145 |
| 5,034,997 A | * | 7/1991 | Iwasaki | 340/825.69 |
| 5,227,780 A | * | 7/1993 | Tigwell | 340/825.69 |
| 5,383,044 A | * | 1/1995 | Borchardt et al. | 340/825.72 |
| 5,659,883 A | * | 8/1997 | Walker et al. | 359/146 |
| 6,396,612 B1 | * | 5/2002 | Bjorndahl | 398/115 |

FOREIGN PATENT DOCUMENTS

EP 0514244 11/1992

OTHER PUBLICATIONS

"Ein tragbares Funk–Fernsteuergerat fur Gewingnungsmaschinen", Weber et al., Gluckauf, Jul. 13, 1967, pp. 375–378, XP002093388.

* cited by examiner

*Primary Examiner*—Brian Zimmerman
(74) *Attorney, Agent, or Firm*—Dykema Gossett; Jeff A Greene

(57) ABSTRACT

The invention realises a remote controlling device of an operative machine which comprises a transmitter arranged on the ground at the disposal of an operator and a receiver arranged inboard, supplied with an accomplishment circuit connected with the drives of such machine. The transmitter comprises a first section which transmits luminous infrared waves and a second section which transmits electromagnetic waves which cooperate with the receiver comprising a first section receiving the luminous infrared waves and a second section receiving the electromagnetic waves. In the receiver electronic means are present, suitable for realising a permission signal which activates the accomplishment circuit only if the first receiving section receives the luminous infrared waves emitted by the first transmitting section.

9 Claims, 1 Drawing Sheet

1
2
2'
2"
3
3'
3"
4
5
6
7
8
9
10
11
12
13
14
15
16
17
18
19
20
21
22
23
24
25
26
27

REMOTE CONTROLLING DEVICE FOR OPERATIVE MACHINES

The invention relates to the sector of the remote controlling devices for machines in general and it relates particularly to a remote controlling device particularly suitable for being applied to rotatory finishing machines which are used for the distribution of asphalt during the execution of road—works. Remote controlling of moving means by ether connections realised by transmitter and receiver, belongs to the known technique.

The more used techniques relate to the use of telecontrols which use luminous waves in the infrared field or radio controls which use electromagnetic waves in the frequency field of dozens megahertz.

In both the cases the connection takes place with an optical displacement, that is in the conditions in which the receiver and the transmitter are visible without the interposition of obstacles.

In particular, the at sight contact between the receiver installed on the operative machine and the transmitter installed on the ground at the disposal of the operator, is requested in order that the operator could control that all the manoeuvres of the operative machine can take place with security conditions.

The distances which can be covered using infrared telecontrols are not so wide as those which could be covered using radio controls with electromagnetic waves. Besides, in case of the use of infrared rays the reception remarkably suffers the environmental conditions because their diffusion is greatly attenuated by the presence of steam or carbonic anhydride.

Therefore, the transmission of complex information by infrared rays is not very reliable, while instead the electromagnetic waves, which permit among other things to cover wider distances and are insensitive to the environmental conditions, are suitable for transferring information of the on/off type. Besides, the connection by electromagnetic waves could be rendered more reliable by modulation and coding techniques of the controls.

The technique of remote controlling operative machines results particularly useful if applied to vibratory finishing machines for the laying off of the asphalt during the execution of road—works because the working conditions for the operators which use such machines are very unhealthy for the presence of tar vapours.

Therefore, for such machines the use of the technique of remote controlling is proposed as a very useful system in order to preserve the sanity of the operators. But it requests that the control should be realised in condition of optical displacement and therefore of maximum functioning security considering the particular kind of work that the vibratory finishing machines execute.

The present invention intends therefore to realise a remote controlling device very reliable, having as main purpose that of permitting a sure check of the machine, being different the environmental conditions in which it operates.

Another purpose that the invention intends to achieve is for the remote controlling device permits the guide of the machine only when it is with optical displacement for the operator.

The said purposes are achieved by the realisation of a remote controlling device of an operative machine, comprising said remote controlling device a transmitter arranged on the ground at the disposal of an operator and a receiver arranged inboard and supplied with at least an accomplishment circuit connected with the controls of the machine itself, and it is characterised in that said transmitter comprises a first transmitting section of luminous infrared waves and a second transmitting section of electromagnetic waves, which cooperate with said receiver which comprises a first receiving section of said luminous infrared waves and a second receiving section of said electromagnetic waves, presenting said receiver electronic means suitable for realising a permission signal in order to activate said accomplishment circuit only if said first receiving section receives said luminous infrared waves emitted by said first transmitting section.

According to a preferred embodiment the device of the invention comprises a first transmitting section of luminous infrared waves which keeps the contact with a corresponding first receiving section of the receiver arranged inboard and a second transmitting section of electromagnetic waves which keeps the contact with a corresponding second receiving section of the same receiver. The transmitter is therefore supplied with two separated sources of signal: the infrared source which keeps the contact with the receiver and the source of radio waves which transmits with suitable modulation, preferably of frequency, the codes relative to the different commands which the operator gives the machine.

The radio waves, for the facility with which they can be modulated, guarantee a right reception of the commands, protected from interferences and mistakes in any different environmental condition. The infrared control, vice—versa, carries out the function of enabling in the receiver the execution of the commands.

Since the radio waves signal is of the on/off type, if, because of particular environmental conditions, it is not received in a sufficient way, it signals a situation in which also the usual control of the operator is precarious and therefore it prevents the execution of any function and stops the machine. The receiving station therefore will execute the command which has been given only if an optical uninterrupted connection exists between the transmitter and the receiver in order to prevent movements of the machine when the remote operator can't see it. The device of the invention is described referring to the enclosed drawings where:

Figures 1, 2:
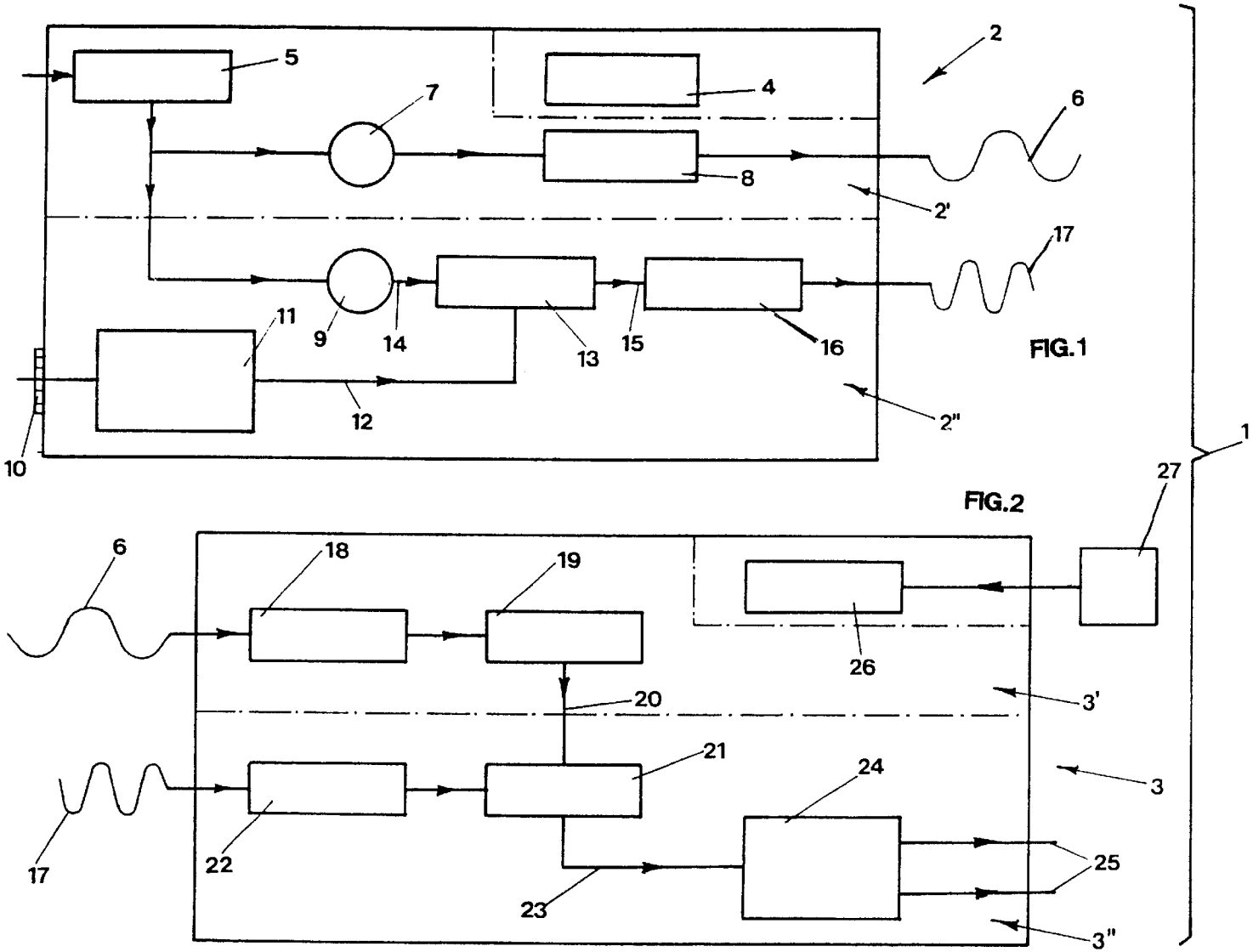
FIG. 1 shows the block diagram of the transmitter.
FIG. 2 shows the block diagram of the receiver.

Referring to the figures it is possible to observe that the device of the invention, indicated as a whole with 1, comprises a transmitter indicated as a whole with 2 and a receiver indicated as a whole with 3.

The transmitter, of a small size and fed by batteries 4, is portable and could be easily put on by the operator by a shoulder strap.

It is clear that in a different embodiment the transmitter could also be arranged on the ground in a stable position.

The transmitter comprises a first transmitting section 2' of an optical infrared signal (luminous infrared waves) and a second transmitting section 2" of electromagnetic waves. The first transmitting section 2' comprises an enabling circuit 5, actionable from the outside, for example by a key, which permits the activation of the transmitting of the station. This creates a luminous infrared wave 6 which is produced by the infrared generator 7 and by the transmitter 8 it is sent to the receiving station 3.

At the same time the frequency generator 9 belonging to the second transmitting section 2", produces an electromagnetic wave with a radio frequency which forms the carrier signal for the commands.

The commands, which correspond to the different function which could be executed by the machine, are given by the operator to the transmitter 2 for example by outer keys 10 and the circuit of the commands 11. These last ones are codified in order to satisfy the requested protocols for the remote movements of operative machines in security conditions.

The electric signal 12 which is this way produced, will provide to modulate by the modulator 13 the carrier 14 in order to obtain the radio signal 15 which the radio transmitter 16 will send in form of electromagnetic waves 17 to the receiving station 3.

The receiver 3 comprises a first receiving section 3' having an infrared receiver 18 which is able to receive the signal 6 coming from the first transmitting section 2' of the transmitter 2 and a detecting circuit 19 which is able to produce a permission signal 20. Such permission signal is produced only in presence of a valid reception and this assures the visibility between the operator and the machine, being the received ray 6 greatly attenuated in presence of eventual fumes, steams or other optical obstacles.

The permission signal 20 when it is valid, will permit to the demodulator 21, belonging to the second receiving section 3" of the receiver to extract from the radio signal 17 received by the radio receiver 22, the code relative to the command to be executed 23 that the accomplishment circuit 24 provides to send to the single drives 25 of the machine.

The whole receiving station which will be without an outer antenna and realised watertight, is fixed to the frame of the machine and the feeder 26, with which it is provided, will receive from the generator 27 of the machine itself the feeding power for its own electronic circuits.

With regard to the functions commanded by the remote operator, he will be able to execute the following commands:

emergency stopping of the machine;

lifting—lowering of the left level;

opening—closing of the left enlargement;

returning action of the left auger;

reversal of the left auger;

returning action of the left strip;

lifting—lowering of the right level;

opening—closing of the right enlargement;

returning action of the right auger;

reversal of the right auger;

returning action of the right strip;

laying of the tamper turns;

laying of the pressure of the front traction.

It is clear that the controlling device of the invention, particularly suitable for being used on vibratory finishing machines for the laying off of petroleum tar during the execution of road—works, could be easily used also for the command of other machines, such for example machines for moving the earth or other.

Even if the invention has been described referring to the figures represented in the enclosed drawing, it is clear that it will be liable of many changes and executive variants, all part of the creative idea expressed by the enclosed claims.

What is claimed is:

1. A remote control device for a machine comprising:

a transmitter separate from the machine at the disposal of an operator;

a receiver on the machine including an accomplishment circuit operatively connected with the machine;

wherein said transmitter includes a first transmitting section of luminous infrared waves and a second transmitting section of electromagnetic waves which cooperate with said receiver; and wherein said receiver includes a first receiving section of luminous infrared waves and a second receiving section of electromagnetic waves, said receiver including electronic means for producing a permission signal for activation of said accomplishment circuit only if said first receiving section receives said luminous infrared waves emitted by said first transmitting section, electromagnetic waves can then be transmitted through said accomplishment circuit of said second receiving section only after receiving and only as long said luminous infrared waves are received through said first receiving section.

2. The remote control device according to claim 1 wherein said first transmitting section includes an enabling circuit for producing an enabling signal a luminous infrared wave generator operatively coupled thereto for producing an infrared (IR) signal in response to the enabling signal; and a transmitter for generating luminous infrared waves corresponding to the IR signal.

3. The remote control device according to claim 2 wherein said second transmitting section includes a frequency generator responsively coupled to the enabling circuit for producing a radio frequency (RF) signal in response to the enabling signal; a modulator connected to the frequency generator for modulating the RF signal; and a radio transmitter electrically connected to the modulator, for generating modulated RF electromagnetic output waves.

4. The remote control device according to claim 3 including a command device for producing command signals, and command keys for controlling the command device; and wherein said modulator is responsively connected with the output of the command device for modulating the RF signal in accordance with the command signals.

5. The remote control device according to claim 1, wherein said first receiving section includes a receiver of luminous infrared waves; and a detector responsively coupled to the receiver.

6. The remote control device according to claim 4 wherein said second receiving section includes a receiver of electromagnetic waves and said accomplishment circuit being responsively coupled to the electromagnetic device for activating the machine.

7. The remote control device according to claim 6, including a demodulator and wherein said accomplishment circuit is connected at the output of the demodulator.

8. The remote control device according to claim 1 wherein said receiver includes a power feeder and a power generator electrically connected with the power feeder in producing a power source.

9. A remote control device for controlling operations of a machine comprising:

a transmitter separated from the machine including an IR transmitter channel and an RF transmitter channel; and a receiver locatable on the machine including an IR receiver and an RF receiver, said RF receiver including a detector for producing an output only in response to the IR signal and a gate coupled to the RF receiver for gating the RF signal only as long as the IR signal is detected.

* * * * *